US005632091A

United States Patent [19]

Brion et al.

[11] Patent Number: 5,632,091

[45] Date of Patent: May 27, 1997

[54] ARCHERY BOW SIGHT

[76] Inventors: James Brion, P.O. Box 1476, Hamilton, Mont. 59840; Tony Hoffman, 411 Linn St., Yankton, S. Dak. 57078

[21] Appl. No.: 453,456

[22] Filed: May 30, 1995

[51] Int. Cl.[6] ..... F41G 1/467

[52] U.S. Cl. ..... 33/265

[58] Field of Search ..... 33/265, 334; 124/86, 124/87, 88

[56] References Cited

U.S. PATENT DOCUMENTS

| | | | |
|---|---|---|---|
| 3,945,127 | 3/1976 | Spencer | 33/265 |
| 4,620,372 | 11/1986 | Goodrich | 33/265 |
| 4,697,350 | 10/1987 | Shepley et al. | 33/265 |
| 4,875,290 | 10/1989 | Finch | 33/265 |
| 4,982,503 | 1/1991 | Land | 33/265 |
| 5,040,301 | 8/1991 | Forbis | 33/265 |
| 5,367,780 | 11/1994 | Savage | 33/265 |

*Primary Examiner*—G. Bradley Bennett

[57] ABSTRACT

An archery bow sight is provided comprising a mounting block, a front sight attached to the mounting block, and a rear sight attached to the mounting block. Further provided are a means and a method of reducing torque and shock produced by an archery bow being shot. The archery bow sight of the present invention utilizes a plurality of corresponding adjustable yardage shooting pins adjustably mounted in a vertical and horizontal manner on the front sight and the rear sight, which front sight and rear sight are telescopically mounted on the mounting block to adjust the elements of the archery bow sight to the individual archer and the individual archery bow. The means of reducing torque and shock include a dead weight slidably mounted on the archery bow sight. The dead weight is slidably mounted on the pair of parallel tubular arms of the front sight support and adjustably attached to the front sight support block by a threaded bolt. The dead weight slides longitudinally on the pair of parallel tubular arms of the front sight support. The means of reducing torque and shock has a pair of springs force the dead weight to return to a neutral position.

6 Claims, 3 Drawing Sheets

ARCHERY BOW SIGHT

The present invention relates to an archery bow sight, and a method of reducing torque and shock produced by an archery bow being shot.

BACKGROUND OF THE INVENTION

Sportsmen are increasingly utilizing archery equipment for hunting and target shooting purposes. Whether hunting or target shooting, improved accuracy remains the goal of the archer. Prior art is aware of archery bow sights for attachment to archery bows. To improve the accuracy of archery bow shots at different distances, various sighting devices have been devised. The most accurate of such prior art archery bow sighting devices provide both front and rear sight members which generally include provisions to compensate for the varying amounts of vertical drop or differing trajectories which occur when the selected target is at different distances from the archer. Generally, the greater the distance between the front and rear sight members, the steadier the archery bow must be held for accuracy. The distance between the front and rear sight members of the archery bow sight should be adjustable to correspond with the archer's ability. While most such prior art bow sighting devices improve the accuracy of use of the archery bow over an archery bow with no sight, significant problems still exist. For instance, it is difficult to estimate different distances when the shot must be quickly taken. Further, it is difficult to provide a consistent anchor point. Further it is difficult to maintain proper eye-to-arrow alignment when shooting uphill or downhill. Further it is difficult to eliminate cant of the archery bow when the shot is to be quickly taken. Further it is difficult minimize inherent vibration from torque and shock of the archery bow being shot.

There is therefore a need for a simple, inexpensive and easily used archery bow sight which will automatically compensate for differences in the distance between the archer and the target, provide a consistent anchor point, maintain proper eye-to-arrow alignment, eliminate cant of the archery bow, and reduce the inherent vibration in the archery bow resulting from the torque and shock of the archery bow being shot.

SUMMARY OF THE INVENTION

The present invention differs from the prior art in that it provides for an archery bow sight for mounting on an archery bow and a method of reducing torque and shock of the archery bow being shot.

Accordingly, it is an object of the present invention to provide a simple, inexpensive and easily used archery bow sight which will automatically compensate for differences in the distance between the archer and the target, provide a consistent anchor point, maintain proper eye-to-arrow alignment, eliminate cant of the archery bow, and reduce the inherent vibration in the archery bow resulting from the torque and shock of the archery bow being shot.

It is an additional object of the present invention to provide an archery bow sight which is telescopically adjustable between a front sight and a rear sight.

It is an additional object of the present invention to provide an archery bow sight which is horizontally adjustable between a front sight and a rear sight.

It is an additional object of the present invention to provide an archery bow sight which is vertically adjustable between a front sight and a rear sight.

It is an additional object of the present invention to provide an archery bow sight which has a plurality of adjustable yardage shooting pins in both a front sight and a rear sight, which plurality of adjustable yardage shooting pins are vertically adjustable between each other.

It is an additional object of the present invention to provide an archery bow sight which has a means of reducing torque and shock of the archery bow being shot.

It is an additional object of the present invention to provide a method of reducing torque and shock of an archery bow being shot.

In accordance with a preferred embodiment of the present invention an archery bow sight is provided comprising a mounting block, a front sight attached to the mounting block, and a rear sight attached to the mounting block. Further provided are a means and a method of reducing torque and shock produced by an archery bow being shot. The archery bow sight of the present invention utilizes a plurality of corresponding adjustable yardage shooting pins adjustably mounted in a vertical and horizontal manner on the front sight and the rear sight, which front sight and rear sight are telescopically mounted on the mounting block to adjust the elements of the archery bow sight to the individual archer and the individual archery bow. A second embodiment of the archery bow sight of the present invention utilizes a means for reducing torque and shock when the archery bow is being shot.

The plurality of corresponding adjustable yardage shooting pins and the means for reducing torque and shock, when adjusted for the individual archer and individual archery bow automatically compensate for differences in the distance between the archer and the target, provide a consistent anchor point, maintain proper eye-to-arrow alignment, eliminate cant of the archery bow, and reduce the inherent vibration in the archery bow resulting from the torque and shock of the archery bow being shot. Further, the means for reducing torque and shock when the archery bow is being shot allows the individual archer to hold the archery bow more steady on target due to a placement of the center of gravity of the archery bow sight being placed within the sight radius. The present invention is useful in correcting "target panic", that is, the tendency of an archer to release the bowstring before the archery bow is fully drawn and the corresponding adjustable yardage shooting pins properly aligned with each other on the target.

The present invention further provides for ease in dismantling the archery bow sight for storage or transit as well as ease and accurate, consistent re-construction of the archery bow sight after storage or transit.

Further objects and advantages of the present invention will become apparent as the description proceeds and when taken in conjunction with the accompanying drawings wherein:

DESCRIPTION OF THE PREFERRED EMBODIMENT

Reference now should be made to the drawings in which the same reference numbers are used throughout the various figures to designate the same components.

The archery bow sight 14 comprises a mounting block 16, a front sight 48 adjustably attached to the mounting block 16, and a rear sight 118 adjustably attached to the mounting block 16. Further provided are a means and a method of reducing torque and shock produced by the archery bow being shot.

Figure 1:
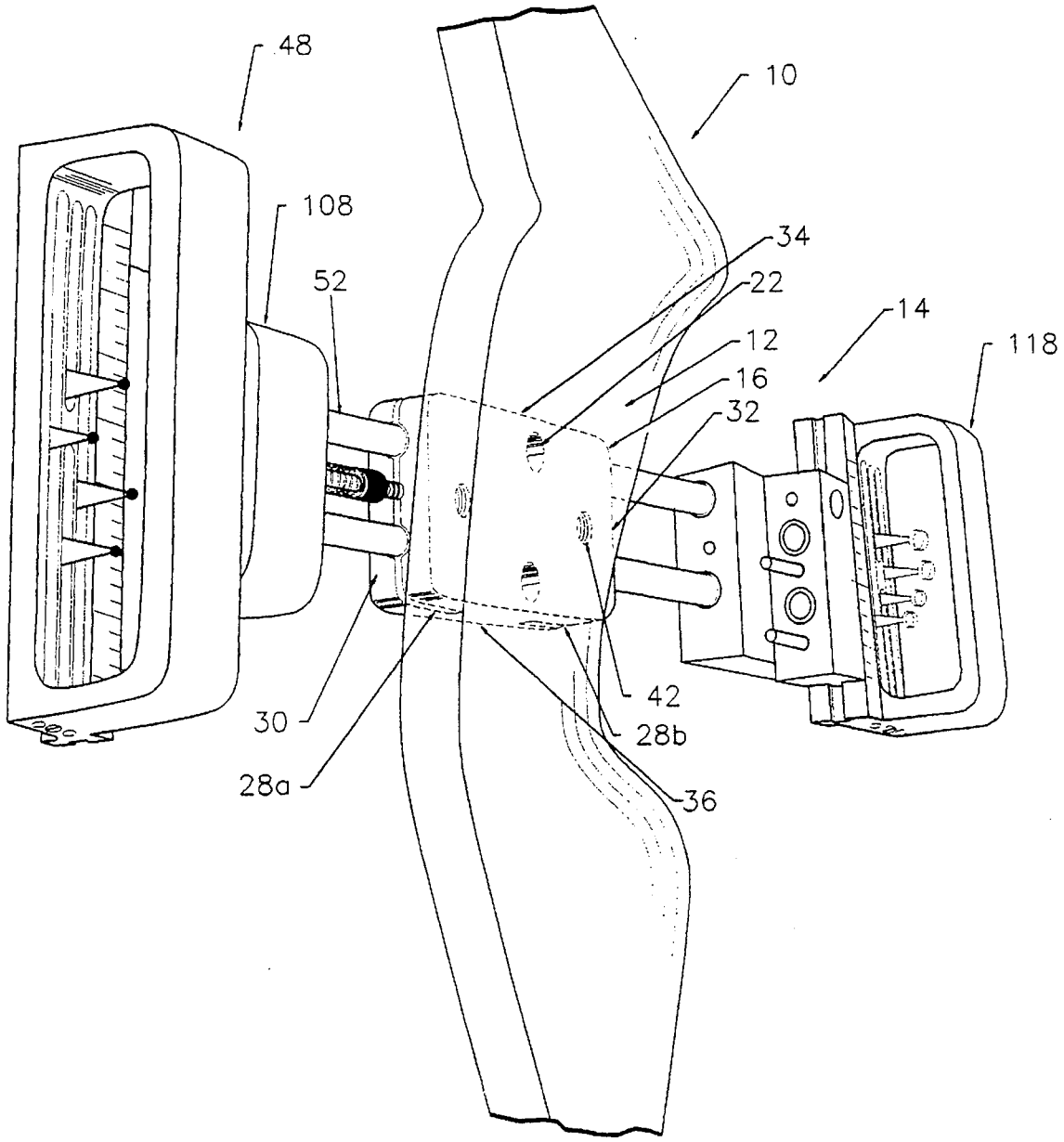
FIG. 1 is a perspective view showing a bow, a mounting block, a front sight and a rear sight.

The archery bow sight 14 is illustrated in FIG. 1 in a side view which shows the manner in which the various components are attached to an archery bow 10 and to one another. The archery bow sight 14 is shown conventionally attached to the archery bow 10 above the arrow rest and the hand grip portion 12 of the archery bow 10 where archery bow sights typically are connected to archery bows.

Figure 2:
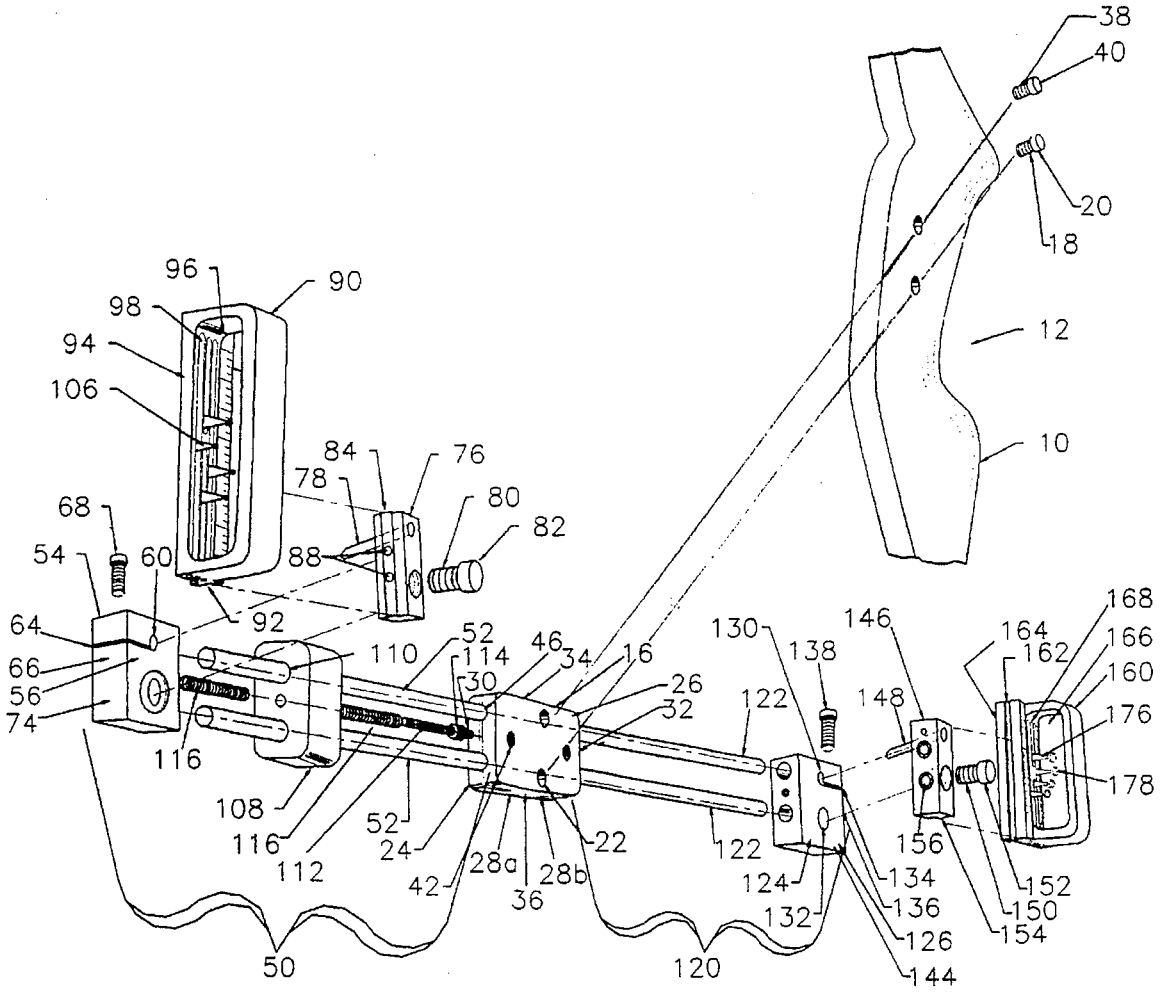
FIG. 2 is an exploded perspective view showing a bow, a mounting block, a means of reducing torque and shock, a front sight and a rear sight.
Figure 3:
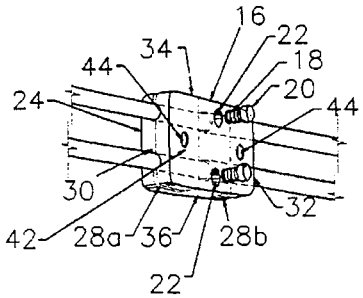
FIG. 3 is a perspective view of the mounting block.

As shown in FIGS. 2 and 3, the archery bow sight 14 has a mounting block 16, which mounting block 16 attaches to the archery bow 10. The mounting block 16 has a plurality of two threaded mounting bolts 18 each having a head 20, which plurality of two, or a pair of, threaded mounting bolts 18 are located respectively one each in a plurality of two mounting holes 22 through the mounting block 16. The plurality of two, or a pair of, threaded mounting bolts 18 attach the mounting block 16 to the archery bow 10 by threadably engaging with the archery bow 10 in a conventional attachment where bow sights typically are connected to an archery bow. The plurality of two mounting holes 22 extend through the mounting block 16 from an outside planar surface 24 of the mounting block 16 to an inside planar surface 26 of the mounting block 16, which outside and inside planar surfaces 24,26 of the mounting block 16 are relative to the archery bow 10 to which the mounting block 16 is attached. The heads 20 of the plurality of two threaded mounting bolts 18 are countersink with respect to the outside planar surface 24 of the mounting block 16.

The mounting block 16 has a plurality of two vertical slits 28*a*, 28*b* therethrough, which plurality of two, or a pair of vertical slits 28*a*, 28*b* are vertical in the mounting block 16 relative to the archery bow 10 to which the mounting block 16 is attached. A first of said plurality of two vertical slits 28*a* is located in the center of a front side 30 of the mounting block 16 and extends the length of the front side 30 of the mounting block 16 from a top side 34 of the mounting block 16 to a bottom side 36 of the mounting block 16 into the mounting block 16. A second of said plurality of two vertical slits 28*b* is located in the center of a rear side 32 of the mounting block 16 and extends the length of the rear side 32 of the mounting block 16 from a top side 34 of the mounting block 16 to a bottom side 36 of the mounting block 16 into the mounting block 16. The front, rear, top and bottom sides 30,32,34,36 of the mounting block 16 referenced with regard to the plurality of two vertical slits 28*a*, 28*b* are relative to the archery bow 10 to which the mounting block 16 is attached.

The mounting block 16 has a plurality of two, or a pair of, threaded securing bolts 38 located respectively one each in a plurality of two, or a pair of, securing bolt holes 42. The plurality of two threaded securing bolts 38 adjustably secure a front sight support 50 of the front sight 48 and a rear sight support 120 of the rear sight 118 to the mounting block 16. The plurality of two securing bolt holes 42 perpendicularly bisect one each of the plurality of two vertical slits 28*a*, and 28*b* and extend between the outside planar surface 24 of the mounting block 16 and the inside planar surface 26 of the mounting block 16. Each of the plurality of two securing bolt holes 42 has a threaded portion 44 between the vertical slit and the inside planar surface 26, which threaded portion 44 has threads which threadably engage the threads of the plurality of two threaded securing bolts 38. The plurality of two threaded securing bolts 38 each have a head 40 which is countersunk into the outside planar surface 24. When the plurality of two threaded securing bolts 38 are tightened by engagement of the threads between the plurality of two threaded securing bolts 38 and the threads of the plurality of two securing bolt holes 42 located in the mounting block 16, the outside planar surface 24 of the mounting block 16 and the inside planar surface 26 of the mounting block 16 are drawn towards one another reducing the openings of the plurality of two vertical slits 28*a*, 28*b* as well as a plurality of two, or a pair of, parallel sight support attachment holes 46, thereby securing the front sight support 50 and the rear sight support 120 to the mounting block 16 in adjustable manner.

The mounting block 16 has a plurality of two parallel sight support attachment holes 46 therethrough for adjustable attachment of the front sight support 50 and the rear sight support 120. The plurality of two parallel sight support attachment holes 46 lie horizontally through the mounting block 16 from the vertical slit on the front side 30 of the mounting block 16 to the vertical slit on the rear side 32 of the mounting block 16. The plurality of two, or a pair of, parallel sight support attachment holes 46 have diameters on the rear portion of the mounting block 16 corresponding with the diameters of a plurality of two hollow parallel tubular arms 122 of the rear sight support 120. The plurality of two sight support attachment holes have diameters on the front portion of the mounting block 16 corresponding with the diameters of a plurality of two, or a pair of, parallel tubular arms 52 of the front sight support 50, which diameters of the plurality of two parallel tubular arms 52 of the front sight support 50 further correspond with and slidably engage the inside diameters of the plurality of two hollow parallel tubular arms 122 of the rear sight support 120. The plurality of two follow parallel tubular arms 122 of the rear sight support 120 slidably engage the plurality of two parallel sight support attachment holes 46 on the rear portion of the mounting block 16 as well as the plurality of two parallel tubular arms 52 of the front sight support 50 in the mounting block 16 by the plurality of two parallel tubular arms 52 of the front sight support 50 sliding inside the plurality of two hollow parallel tubular arms 122 of the rear sight support 120. Thus, the front sight support 50 and the rear sight support 120 slidably engage the mounting block 16 and each other, which slidable engagement provides for telescopic adjustment of the front sight 48 and the rear sight 118 between each other as well as the mounting block 16.

Figure 4:
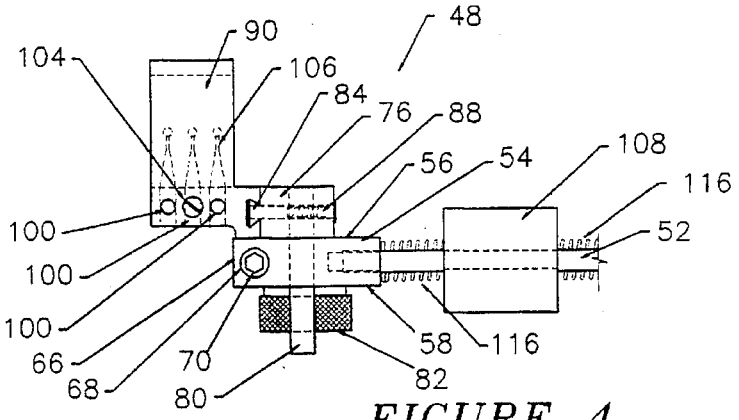
FIG. 4 is a top view of the means for reducing torque and shock and the front sight.
Figure 5:
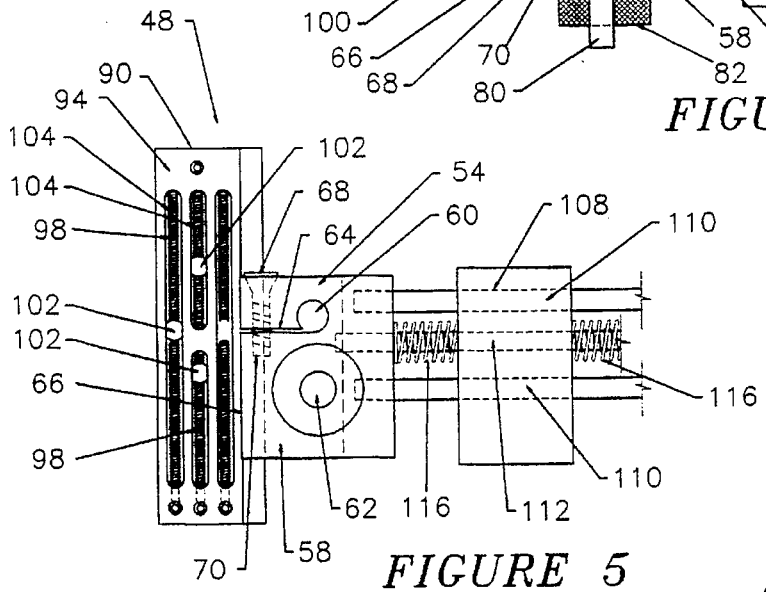
FIG. 5 is a side view of the means for reducing torque and shock and the front sight.
Figure 6:
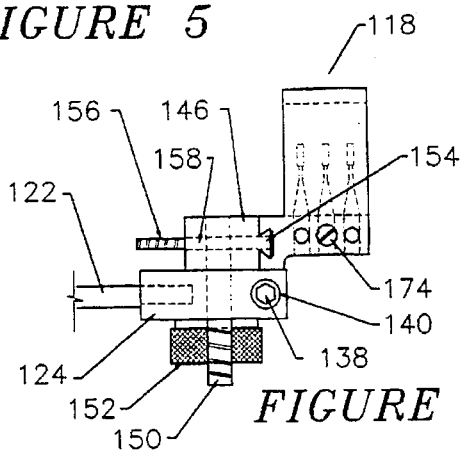
FIG. 6 is a top view of the rear sight.
Figure 7:
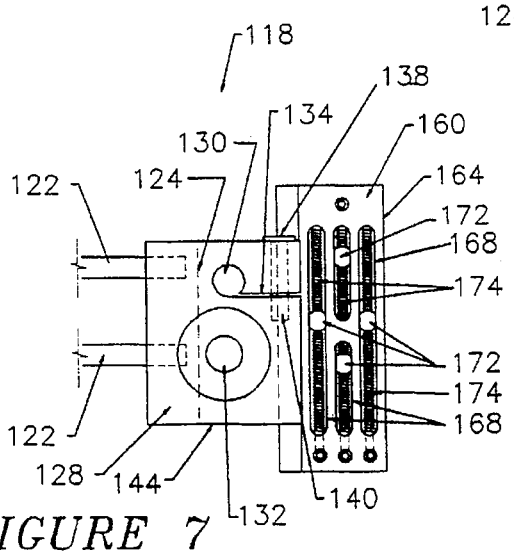
FIG. 7 is a side view of the rear sight.

As shown in FIGS. 4 and 5, the archery bow sight 14 has a front sight 48, which front sight 48 has a front sight support 50 for adjustable attachment of the front sight 48 to the mounting block 16. The front sight support 50 interconnects the front sight 48 and the mounting block 16 in slidably adjustable manner. The front sight support 50 has a plurality of two parallel tubular arms 52. The plurality of two parallel tubular arms 52 of the front sight support 50 have an outside diameter which slidably engages the two parallel sight support attachment holes on the front portion of the mounting block 16 as well as the interior diameter of the plurality of two hollow parallel tubular arms 122 of the rear sight support 120.

The front sight support 50 has a front sight support block 54, which front sight support block 54 is securely attached to the plurality of two parallel tubular arms 52 of the front sight support 50 as well as a front sight plate 76. The front sight 48 has a front sight plate 76, which front sight plate 76 slidably attaches to an inner planar surface 56 of the front sight support block 54 in laterally adjustable manner by means of a pin 78 on the front sight plate 76, which pin 78 extends through a first hole 60 through the front sight support block 54 from the inner planar surface 56 of the front sight support block 54 to an outer planar surface 58 of the front sight support block 54. The front sight plate 76 further has a threaded bolt 80, which threaded bolt 80 extends laterally from the front sight plate 76 through a second hole 62 through the front sight support block 54 from the inner planar surface 56 of the front sight support block 54 to the outer planar surface 58 of the front sight support block 54. The threaded bolt 80 has a threaded nut 82 abutting the outer planar surface 58 of the front sight support block 54, which threaded nut 82 provides for lateral adjustment of the front sight plate 76 relative to the front sight support block 54 by adjustment of the threaded nut 82 on the threaded bolt 80 causing the front sight plate 76 to laterally adjust on the pin 78 relative to the front sight support block 54. Lateral adjustment of the front sight plate 76 to the front sight support block 54 is relative to the archery bow 10 to which the mounting block 16 is attached. The front sight plate 76 further has a dovetail ridge 84 which engages in slidable manner a dovetail groove 92 located on a front sight member 90. The front sight plate 76 has a plurality of two, or a pair of, countersunk threaded bolts 86 located respectively one each in a plurality of two, or a pair of, holes 88 through the front sight plate 76. The plurality of two countersunk threaded bolts 86 exit through the dovetail ridge 84 of the front sight plate 76 and abut the dovetail groove 92 of the front sight member 90 causing the dovetail ridge 84 of the front sight plate 76 to securely engage the dovetail groove 92 of the front sight member 90.

The front sight support block 54 has a horizontal slit 64 on a front side 66, which horizontal aspect of the horizontal slit 64 and front side 66 of the front sight support block 54 are relative to the archery bow 10 to which the mounting block 16 is attached. The horizontal slit 64 extends from the front side 66 of the front sight support block 54 into the front sight support block 54 to terminate at the first hole 60 extending through the front sight support block 54. The front sight support block 54 has a countersunk threaded bolt 68, which countersunk threaded bolt 68 lies within a threaded hole 70 in the front sight support block 54. The threaded hole 70 perpendicularly bisects the horizontal slit 64 of the front sight support block 54 at the front of the front sight support block 54. The threaded hole 70 has threads located in the front bottom portion 74 of the front sight support block 54, which front bottom portion 74 of the front sight support block 54 is relative to the archery bow 10 to which the mounting block 16 is attached. The threads of the threaded hole 70 of the front sight support block 54 are compatible with the threads of the countersunk threaded bolt 68 and when the threads of the countersunk threaded bolt 68 are engaged with the threads of the threaded hole 70 of the front sight support block 54 and the countersunk threaded bolt 68 is turned in a tightening manner, the horizontal slit 64 reduces in size thereby securing the pin 78 of the front sight plate 76 onto the front sight support block 54.

The front sight 48 has a front sight member 90, which front sight member 90 is attached to the front sight plate 76 in horizontally adjustable manner. The front sight member 90 has a dovetail groove 92 on a long side 94, which dovetail groove 92 engages in up-down slidable manner the dovetail ridge 84 located on the front sight plate 76 to provide for up-down adjustment of the front sight member 90 relative to the mounting block 16. The front sight member 90 has an open center elongated rectangle 96. The open center elongated rectangle 96 of the front sight member 90 has four elongated vertical slots 98 therein, which elongated vertical slots 98 are located in the long side 94 of the open center elongated rectangle 96 having the dovetail groove 92 and are vertical relative to the archery bow 10 to which the mounting block 16 is attached. The elongated vertical slots 98 are positioned on three parallel elongated vertical axes 100 in the long side 94 of the open center elongated rectangle 96. The two outer parallel elongated vertical slots 98 extend one each the length of the long side 94 of the open center elongated rectangle 96 on two outer parallel elongated vertical axes 100. The middle parallel elongated vertical axis 100 has a plurality of two, or a pair of, elongated vertical slots 98 each extending approximately one-half the length of the long side 94 of the open center elongated rectangle 96. The elongated vertical slots 98 provide for placement on the front sight member 90 of four adjustable yardage shooting pins 106. The adjustable yardage shooting pins 106 on the front sight member 90 are individually adjustable vertically within the elongated vertical slots 98 and thus within the open center portion of the elongated rectangle of the front sight member 90. Each of the adjustable yardage shooting pins 106 is attached to one each of four moveable blocks 102, which moveable blocks 102 are threadably mounted one each on four threaded bolts 104 located one each within one each of the elongated vertical slots 98. Each of the adjustable yardage shooting pins 106 is thus capable of independent vertical adjustment within the open center portion of the elongated rectangle of the front sight member 90, said vertical adjustment being accomplished by turning each of the threaded bolts 104 to either vertically raise or lower each of the moveable blocks 102 in the elongated vertical slots 98 and thus the adjustable yardage shooting pins 106 within the open center portion of the elongated rectangle of the front sight member 90.

Adjustable yardage shooting pins 106 are utilized with a variety of archery bow sights but the manner of attachment and adjustment of the adjustable yardage shooting pins 106 in the front sight member 90 of the present invention has not been heretofore provided.

The archery bow sight 14 has a means of reducing torque and shock produced by the archery bow 10 being shot. The means of reducing torque and shock include a dead weight 108 slidably mounted on the archery bow sight 14. The dead weight 108 has a plurality of three holes 110 therethrough, which dead weight 108 is slidably mounted on the plurality of two parallel tubular arms 52 of the front sight support 50 and adjustably attached to the front sight support block 54 by a threaded bolt 112. The dead weight 108 is slidably mounted on the plurality of two parallel tubular arms 52 of the front sight support 50 by one each of the plurality of two parallel tubular arms 52 of the front sight support 50 passing through one each of two of the plurality of three holes 110 through the dead weight 108. The threaded bolt 112 extends from the front sight support block 54 through the third hole of the plurality of three holes 110 of the dead weight 108 towards the mounting block 16 between the two parallel tubular arms of the front sight support 50. The threaded bolt 112 freely extends through the third hole through the dead weight 108 and threadably engages the front sight support block 54. The dead weight 108 is thus able to slide longitudinally on the plurality of two parallel tubular arms 52 of the front sight support 50 and the threaded bolt 112 between the mounting block 16 and the front sight support block 54. The means of reducing torque and shock has a plurality of two, or a pair of, springs 116 mounted on the threaded bolt 112. A first spring of the plurality of two springs 116 is mounted on the threaded bolt 112 between the front sight support block 54 and the dead weight 108. A second spring of the plurality of two springs 116 is mounted on the threaded bolt 112 between the dead weight 108 and a head 114 of the threaded bolt 112. The mounting of the plurality of two springs 116 on the threaded bolt 112, one each on each side of the dead weight 108, allows the dead weight 108 to slide longitudinally on the plurality of two parallel tubular arms 52 of the front sight support 50 and the threaded bolt 112 in a direction toward or away from the front sight support block 54 and the mounting block 16 when the archery bow 10 is shot. The plurality of two springs 116 force the dead weight 108 to return to a neutral position by the plurality of two springs 116 compressing and decompressing in directions opposite each other on the threaded bolt 112. The neutral position and degree of sliding of the dead weight 108 on the plurality of two parallel tubular arms 52 of the front sight support 50 and the threaded bolt 112 is determined by the compression placed upon the plurality of two springs 116 by tightening the threaded bolt 112.

As shown in FIGS. 2 and 3, archery bow sight 14 has a rear sight 118, which rear sight 118 has a rear sight support 120 for adjustable attachment of the rear sight 118 to the mounting block 16. The rear sight support 120 interconnects the rear sight 118 and the mounting block 16 in slidably adjustable manner. The rear sight support 120 has a plurality of two hollow parallel tubular arms 122. The plurality of two hollow parallel tubular arms 122 of the rear sight support 120 have an outside diameter which slidably engages the two parallel sight support attachment holes on the rear portion of the mounting block 16 and an interior diameter which slidably engages the plurality of two parallel tubular arms 52 of the front sight support 50.

The rear sight support 120 has a rear sight support block 124, which rear sight support block 124 is securely attached to the plurality of two hollow parallel tubular arms 122 of the rear sight support 120 as well as a rear sight plate 146. The rear sight 118 has a rear sight plate 146, which rear sight plate 146 slidably attaches to an inner planar surface 126 of the rear sight support block 124 in laterally adjustable manner by means of a pin 148 on the rear sight plate 146, which pin 148 extends through a first hole 130 through the rear sight support block 124 from the inner planar surface 126 of the rear sight support block 124 to an outer planar surface 128 of the rear sight support block 124. The rear sight plate 146 further has a threaded bolt 150, which threaded bolt 150 extends laterally from the rear sight plate 146 through a second hole 132 through the rear sight support block 124 from the inner planar surface 126 of the rear sight support block 124 to the outer planar surface 128 of the rear sight support block 124. The threaded bolt 150 has a threaded nut 152 abutting the outer planar surface 128 of the rear sight support block 124, which threaded nut 152 provides for lateral adjustment of the rear sight plate 146 relative to the rear sight support block 124 by adjustment of the threaded nut 152 on the threaded bolt 150 causing the rear sight plate 146 to laterally adjust on the pin 148 relative to the rear sight support block 124. Lateral adjustment of the rear sight plate 146 to the rear sight support block 124 is relative to the archery bow 10 to which the mounting block 16 is attached. The rear sight plate 146 further has a dovetail ridge 154 which engages in slidable manner a dovetail groove 162 located on a rear sight member 160. The rear sight plate 146 has a plurality of two, or a pair of, countersunk threaded bolts 156 located respectively one each in a plurality of two, or a pair of, holes 158 through the rear sight plate 146. The plurality of two countersunk threaded bolts 156 exit through the dovetail ridge 154 of the rear sight plate 146 and abut the dovetail groove 162 of the rear sight member 160 causing the dovetail ridge 154 of the rear sight plate 146 to securely engage the dovetail groove 162 of the rear sight member 160.

The rear sight support block 124 has a horizontal slit 134 on a rear side 136, which horizontal aspect of the horizontal slit 134 and rear side 136 of the rear sight support block 124 are relative to the archery bow 10 to which the mounting block 16 is attached. The horizontal slit 134 extends from the rear side 136 of the rear sight support block 124 into the rear sight support block 124 to terminate at the first hole 130 extending through the rear sight support block 124. The rear sight support block 124 has a countersunk threaded bolt 138, which countersunk threaded bolt 138 lies within a threaded hole 140 in the rear sight support block 124. The threaded hole 140 perpendicularly bisects the horizontal slit 134 of the rear sight support block 124 at the rear of the rear sight support block 124. The threaded hole 140 has threads located in the rear bottom portion 144 of the rear sight support block 124, which rear bottom portion 144 of the rear sight support block 124 is relative to the archery bow 10 to which the mounting block 16 is attached. The threads of the threaded hole 140 of the rear sight support block 124 are compatible with the threads of the countersunk threaded bolt 138 and when the threads of the countersunk threaded bolt 138 are engaged with the threads of the threaded hole 140 of the rear sight support block 124 and the countersunk threaded bolt 138 is turned in a tightening manner, the horizontal slit 134 reduces in size thereby securing the pin 148 of the rear sight plate 146 onto the rear sight support block 124.

The rear sight 118 has a rear sight member 160, which rear sight member 160 is attached to the rear sight plate 146 in horizontally adjustable manner. The rear sight member 160 has a dovetail groove 162 on a long side 164, which dovetail groove 162 engages in up-down slidable manner the dovetail ridge 154 located on the rear sight plate 146 to provide for up-down adjustment of the rear sight member 160 relative to the mounting block 16. The rear sight member 160 has an open center elongated rectangle 166. The open center elongated rectangle 166 of the rear sight member 160 has four elongated vertical slots 168 therein, which elongated vertical slots 168 are located in the long side 164 of the open center elongated rectangle 166 having the dovetail groove 162 and are vertical relative to the archery bow 10 to which the mounting block 16 is attached. The elongated vertical slots 168 are positioned on three parallel elongated vertical axes in the long side 164 of the open center elongated rectangle 166. The two outer parallel elongated vertical slots 168 extend one each the length of the long side 164 of the open center elongated rectangle 166 on two outer parallel elongated vertical axes. The middle parallel elongated vertical axis has a plurality of two elongated vertical slots 168 each extending approximately one-half the length of the long side 164 of the open center elongated rectangle 166. The elongated vertical slots 168 provide for placement on the rear sight member 160 of four adjustable yardage shooting pins 176. The adjustable yardage shooting pins 176 on the rear sight member 160 are individually adjustable vertically within the elongated vertical slots 168 and thus within the open center portion of the elongated rectangle of the rear sight member 160. Each of the adjustable yardage shooting pins 176 is attached to one each of from one to a plurality of four moveable blocks 172, which moveable blocks 172 are threadably mounted one each on four threaded bolts 174 located one each within one each of the elongated slots. Each of the adjustable yardage shooting pins 176 is thus capable of independent vertical adjustment within the open center portion of the elongated rectangle of the rear sight member 160, said vertical adjustment being accomplished by turning each of the threaded bolts 174 to either vertically raise or lower each of the moveable blocks 172 in the elongated vertical slots 168 and thus the adjustable yardage shooting pins 176 within the open center portion of the elongated rectangle of the rear sight member 160.

Figure 8:
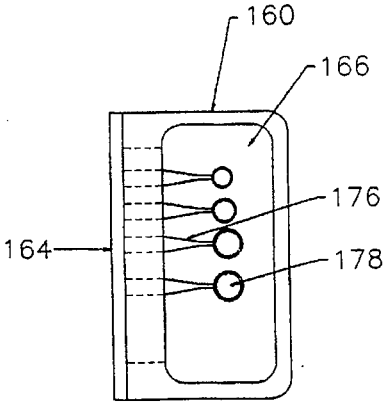
FIG. 8 is a view from the back of the rear sight showing adjustable yardage circular peep-sights.

By way of illustration and not limitation, in one embodiment of the present invention, shown in FIG. 8 the adjustable yardage shooting pins 176 within the center portion of the elongated rectangle of the rear sight member 160 further comprise adjustable yardage circular peep-sights 178.

Adjustable yardage shooting pins 176 and circular peep-sights 178 are utilized with a variety of archery bow sights but the manner of attachment and adjustment of the adjustable yardage shooting pins 176 and circular peep-sights 178 in the rear sight member 160 of the present invention has not been heretofore provided.

A method of reducing torque and shock produced by the archery bow 10 being shot is provided. The method of reducing torque and shock includes providing an archery bow sight 14 having a mounting block 16, a front sight 48 adjustably attached to the mounting block 16, a means of reducing torque and shock produced by the archery bow 10 being shot, and a rear sight 118 adjustably attached to the mounting block 16. The means of reducing torque and shock include a dead weight 108 slidably mounted on the archery bow sight 14. The dead weight 108 reduces torque and shock produced by the archery bow 10 being shot. The dead weight 108 is slidably mounted on a plurality of two parallel tubular arms 52 of a front sight support 50. The dead weight 108 is adjustably attached to a front sight support block 54. The front sight support block 54 has a threaded bolt 112 which extends from the front sight support block 54 through the dead weight 108 towards the mounting block 16 between the two parallel tubular arms of the front sight support 50. The threaded bolt 112 freely extends through a hole through the dead weight 108 and threadably engages the front sight support block 54. The dead weight 108 slides longitudinally on the plurality of two parallel tubular arms 52 of the front sight support 50 and the threaded bolt 112 between the mounting block 16 and the front sight support block 54. The threaded bolt 112 has a plurality of two springs 116, which plurality of two springs 116 are mounted on the threaded bolt 112. A first spring of the plurality of two springs 116 is mounted on the threaded bolt 112 between the front sight support block 54 and the dead weight 108. A second spring of the plurality of two springs 116 is mounted on the threaded bolt 112 between the dead weight 108 and a head 114 of the threaded bolt 112. The mounting of the plurality of two springs 116 on the threaded bolt 112, one each on each side of the dead weight 108, allows the dead weight 108 to slide longitudinally on the plurality of two parallel tubular arms 52 of the front sight support 50 and the threaded bolt 112 in a direction toward or away from the front sight support block 54 and the mounting block 16 when the archery bow 10 is shot. The plurality of two springs 116 force the dead weight 108 to return to a neutral position by the plurality of two springs 116 compressing and decompressing in directions opposite each other on the threaded bolt 112. The neutral position and degree of sliding by the dead weight 108 on the plurality of two parallel tubular arms 52 of the front sight support 50 and the threaded bolt 112 is determined by the compression placed upon the plurality of two springs 116 by tightening the threaded bolt 112.

The method of reducing torque and shock further includes attaching the archery bow sight 14 to the archery bow 10 and adjusting the slidability of the dead weight 108 on the plurality of two parallel tubular arms 52 of the front sight support 50 by tightening or loosening the threaded bolt 112 which freely passes through the dead weight 108 and threadably engages the front sight support block 54.

To properly use the archery bow sight 14 and method which have been described hereinabove, it is necessary to effect initial adjustments to uniquely adapt the archery bow sight 14 for use of the individual archer using the particular archery bow 10 upon which the archery bow sight 14 is mounted.

Generally, the archery bow sight 14 is mounted on the archery bow 10 by attaching the mounting block 16 to the archery bow 10 and then attaching the front sight 48 and the rear sight 118 to the mounting block 16. Mounting the archery bow sight 14 on the archery bow 10 in this manner provides for ease of assembly and disassembly of the archery bow sight 14 when transporting the archery bow 10. Once the archery bow sight 14 is mounted on the archery bow 10, the individual archer must telescopically adjust the length of the front sight 48 and the rear sight 118 with respect to each other and the mounting block 16. The individual archer must further adjust the position of the front sight plate 76 with respect to the front sight support block 54 and the rear sight plate 146 with respect to the rear sight support block 124, and the front sight plate 76 with respect to the rear sight plate 146. The individual archer must further adjust the front sight member 90 with respect to the front sight plate 76 and the rear sight member 160 with respect to the rear sight plate 146, and the front sight member 90 with respect to the rear sight member 160. The individual archer must individually adjust each of the individual adjustable yardage shooting pins 106 with respect to the other individual adjustable yardage shooting pins 106 in the front sight member 90 and each of the individual adjustable yardage shooting pins 176 with respect to the other individual adjustable yardage shooting pins 176 in the rear sight member 160, and the individual adjustable yardage shooting pins 106 in the front sight member 90 with the individual adjustable yardage shooting pins 176 in the rear sight member 160. Finally, the individual archer must adjust the slidability of the dead weight 108 on the plurality of two parallel tubular arms 52 of the front sight support 50 to accommodate the weight of the arrow being shot. When the hereinabove adjustments are made for an individual archer, the archery bow 10 will be adjusted or fine tuned for said individual archer for preselected distances and preselected arrow weight.

By reason of the vertically aligned reference points, the individually adjustable shooting pins in the front sight member 90 and the individually adjustable shooting pins in the rear sight member 160 automatically align the archery bow 10 such that the problem of cant of the archery bow 10 is substantially minimized when the string is in drawn position to a consistent anchor point. Viewed from the back of the archery bow 10, the individual archer is capable of immediately aligning the particular adjustable shooting pin in the rear sight member 160 with the particular adjustable shooting pin in the front sight member 90 for the distance of the shot while automatically substantially minimizing cant in the archery bow 10 in the performance of such shot. Adjustment of the dead weight 108 by tightening or loosening the threaded bolt 112 which freely passes through the dead weight 108 and threadably engages the front sight support block 54 allows for individual adjustment of the archery bow 10 in accordance with the draw weight of the archery bow 10 as well as the weight of the particular arrow being shot and provides for the torque and shock produced by the archery bow 10 being shot to be transferred through the bow to the dead weight 108 which absorbs the same.

The foregoing description of the preferred embodiment of the invention is to be considered illustrative of the invention and not as limiting. Various changes and departures may be made to the invention and method herein without departing from the spirit and scope thereof. Accordingly, it is not intended that the invention and method herein be limited to that specifically described in the specification or as illustrated in the drawings, but only as set forth in the claims. From the drawings and above-description, it is apparent that an archery bow sight constructed in accordance with the invention and method herein provides desirable features and advantages. While the form of the archery bow sight and method herein described constitutes a preferred embodiment of the invention, it is to be understood that the archery bow sight and method herein are capable of further modification, and this application is intended to cover any variations, uses, or adaption of the archery bow sight and method herein, following in general the principles of the archery bow sight and method herein and include such departures from the present disclosure as to come within knowledge or customary practice in the art to which the archery bow sight and method herein pertain, and as may be applied to the essential features hereinbefore set forth and falling within the scope of the archery bow sight and method herein or the limits of the appended claims.

What is claimed and desired to be secured by United States Letters Patent is:

1. For use with an archery bow having a bowstring, an arrow rest and handgrip portion, an archery bow sight for attachment to the archery bow, said archery bow sight comprising:

a mounting block, said mounting block for attachment to the archery bow;

a pair of threaded mounting bolts for attachment of said mounting block to the archery bow, said pair of threaded mounting bolts each having a head and being located respectively one each in a pair of mounting holes through said mounting block;

said pair of mounting holes extending through said mounting block from an outside planar surface of said mounting block to an inside planar surface of said mounting block;

said heads of said pair of threaded mounting bolts being countersunk with respect to said outside planar surface of said mounting block;

said mounting block having a pair of vertical slits therethrough, with a first vertical slit of said pair of vertical slits being located on a front side of said mounting block and extending a length of said front side of the mounting block from a top side of said mounting block to a bottom side of said mounting block into said mounting block, and a second vertical slit of said pair of vertical slits being located on a rear side of said mounting block and extending a length of said rear side of said mounting block from said top side of said mounting block to said bottom side of said mounting block into said mounting block;

said mounting block having a pair of threaded securing bolts located respectively one each in a pair of securing bolt holes, said pair of threaded securing bolts adjustably securing a front sight and a rear sight to said mounting block;

said pair of securing bolt holes perpendicularly bisecting one each of said pair of vertical slits and extending between said outside planar surface of said mounting block and said inside planar surface of said mounting block;

said pair of securing bolt holes each having a threaded portion between said vertical slit and said inside planar surface, said threaded portion having threads which threadably engage said pair of threaded securing bolts;

said pair of threaded securing bolts each having a head which is countersunk into said outside planar surface of said mounting block;

said mounting block having a pair of parallel sight support attachment holes therethrough for adjustable attachment of said front sight and said rear sight;

said pair of parallel sight support attachment holes lying horizontally through said mounting block from said vertical slit on said front side of said mounting block to said vertical slit on said rear side of said mounting block, with each of said pair of parallel sight support attachment holes having a diameter on said rear portion of said mounting block and a diameter on said front portion of said mounting block;

a front sight, said front sight being adjustably attached to said mounting block; and, a rear sight, said rear sight being adjustably attached to said mounting block.

2. The archery bow sight as claimed in claim 1, wherein said front sight further comprises:

a front sight support for adjustable attachment of said front sight to said mounting block, said front sight support interconnecting said front sight and said mounting block in slidably adjustable manner;

said front sight support having a pair of parallel tubular arms, said pair of parallel tubular arms of said front sight support having an outside diameter which slidably engages said pair of parallel sight support attachment holes on said front portion of said mounting block and an interior diameter of a pair of hollow parallel tubular arms of said rear sight;

said front sight support having a front sight support block, said front sight support block being securely attached to said pair of parallel tubular arms of said front sight support as well as a front sight plate;

said front sight having a front sight plate, said front sight plate being slidably attached to an inner planar surface of said front sight support block in laterally adjustable manner by means of a pin on said front sight plate;

said pin on said front sight plate extending through a first hole through said front sight support block from said inner planar surface of said front sight support block to an outer planar surface of said front sight support block;

said front sight plate having a threaded bolt, said threaded bolt extending laterally from said front sight plate through a second hole through said front sight support block from said inner planar surface of said front sight support block to said outer planar surface of said front sight support block;

said threaded bolt having a threaded nut, said threaded nut abutting said outer planar surface of said front sight support block and providing for lateral adjustment of said front sight plate relative to said front sight support block by adjustment of said threaded nut on said threaded bolt causing said front sight plate to laterally adjust on said pin relative to said front sight support block;

said front sight plate having a dovetail ridge, said dovetail ridge engaging in slidable manner a dovetail groove located on a front sight member;

said front sight plate having a pair of countersunk threaded bolts, said pair of countersunk threaded bolts being located respectively one each in a pair of holes through said front sight plate;

said pair of countersunk threaded bolts exiting through said dovetail ridge of said front sight plate and abutting said dovetail groove of said front sight member;

said front sight support block having a horizontal slit, said horizontal slit being on a front side of said front sight support block, and extending from said front side of said front sight support block into said front sight support block and terminating at said first hole extending through said front sight support block;

said front sight support block having a countersunk threaded bolt, said countersunk threaded bolt lying within a threaded hole in said front sight support block;

said threaded hole perpendicularly bisecting said horizontal slit of said front sight support block at said front of said front sight support block and having threads located in said front bottom portion of said front sight support block;

said threads of said threaded hole of said front sight support block being compatible with said threads of said threaded bolt;

said front sight having a front sight member, said front sight member being attached to said front sight plate in horizontally adjustable manner;

said front sight member having a dovetail groove, said dovetail groove being on a long side of said front sight member and engaging in up-down slidable manner said dovetail ridge located on said front sight plate;

said front sight member having an open center elongated rectangle, said open center elongated rectangle having a foursome of elongated vertical slots;

said foursome of elongated vertical slots being located in said long side of said open center elongated rectangle having said dovetail groove and being positioned on a threesome of parallel elongated vertical axes in said long side of said open center elongated rectangle, with a pair outer parallel elongated vertical slots of said foursome of elongated vertical slots extending one each a length of said long side of said open center elongated rectangle on two outer parallel elongated vertical axes of said threesome of parallel elongated vertical axes and a middle parallel elongated vertical axis of said threesome of parallel elongated vertical axes having a pair of elongated vertical slots each extending one-half said length of said long side of said open center elongated rectangle;

said foursome of elongated vertical slots providing for placement on said front sight member of a foursome of adjustable yardage shooting pins, said foursome of adjustable yardage shooting pins being individually adjustable vertically within said elongated vertical slots; and, said foursome of adjustable yardage shooting pins being one each individually attached to one each of a foursome of moveable blocks, said foursome of moveable blocks being threadably mounted one each on a foursome of threaded bolts located one each within one each of said foursome of elongated vertical slots.

3. The archery bow sight as claimed in claim 2, wherein said rear sight further comprises:

a rear sight support for adjustable attachment of said rear sight to said mounting block, said rear sight support interconnecting said rear sight and said mounting block in slidably adjustable manner;

said rear sight support having a pair of hollow parallel tubular arms, said pair of hollow parallel tubular arms of said rear sight support having an outside diameter which slidably engages said pair of parallel sight support attachment holes on said rear portion of said mounting block and an interior diameter which slidably engages said pair of parallel tubular arms of said front sight;

said rear sight support having a rear sight support block, said rear sight support block being securely attached to said pair of hollow parallel tubular arms of said rear sight support as well as a rear sight plate;

said rear sight having a rear sight plate, said rear sight plate being slidably attached to an inner planar surface of said rear sight support block in laterally adjustable manner by means of a pin on said rear sight plate;

said pin on said rear sight plate extending through a first hole through said rear sight support block from said inner planar surface of said rear sight support block to an outer planar surface of said rear sight support block;

said rear sight plate having a threaded bolt, said threaded bolt extending laterally from said rear sight plate through a second hole through said rear sight support block from said inner planar surface of said rear sight support block to said outer planar surface of said rear sight support block;

said threaded bolt having a threaded nut, said threaded nut abutting said outer planar surface of said rear sight support block and providing for lateral adjustment of said rear sight plate relative to said rear sight support block by adjustment of said threaded nut on said threaded bolt causing said rear sight plate to laterally adjust on said pin relative to said rear sight support block;

said rear sight plate further having a dovetail ridge, said dovetail ridge engaging in slidable manner a dovetail groove located on a rear sight member;

said rear sight plate having a pair of countersunk threaded bolts, said pair of countersunk threaded bolts being located respectively one each in a pair of holes through said rear sight plate;

said pair of countersunk threaded bolts exiting through said dovetail ridge of said rear sight plate and abutting said dovetail groove of said rear sight member;

said rear sight support block having a horizontal slit, said horizontal slit being on a rear side of said rear sight support block, and extending from said rear side of said rear sight support block into said rear sight support block and terminating at said first hole extending through said rear sight support block;

said rear sight support block having a countersunk threaded bolt, said countersunk threaded bolt lying within a threaded hole in said rear sight support block;

said threaded hole perpendicularly bisecting said horizontal slit of said rear sight support block at said rear of said rear sight support block and having threads located in said rear bottom portion of said rear sight support block;

said threads of said threaded hole of said rear sight support block being compatible with said threads of said threaded bolt;

said rear sight having a rear sight member, said rear sight member being attached to said rear sight plate in horizontally adjustable manner;

said rear sight member having a dovetail groove, said dovetail groove being on a long side of said rear sight member and engaging in up-down slidable manner said dovetail ridge located on said rear sight plate;

said rear sight member having an open center elongated rectangle, said open center elongated rectangle having a foursome of elongated vertical slots;

said foursome of elongated vertical slots being located in said long side of said open center elongated rectangle having said dovetail groove and being positioned on a a threesome of parallel elongated vertical axes in said long side of said open center elongated rectangle, with a pair of outer parallel elongated vertical slots of said foursome of elongated vertical slots extending one each a length of said long side of said open center elongated rectangle on two outer parallel elongated vertical axes of said threesome of parallel elongated vertical axes and a middle parallel elongated vertical axis of said threesome of parallel elongated vertical axes having a pair of elongated vertical slots each extending one-half said length of said long side of said open center elongated rectangle;

said foursome of elongated vertical slots providing for placement on said rear sight member of a foursome of adjustable yardage shooting pins, said foursome of adjustable yardage shooting pins being individually adjustable vertically within said foursome of elongated vertical slots; and, said foursome of adjustable yardage shooting pins being one each individually attached to one each of a foursome of moveable blocks, said foursome of moveable blocks being threadably mounted one each on one each of a foursome of threaded bolts located one each within one each of said foursome of elongated slots.

4. The archery bow sight as claimed in claim 3, wherein said foursome of adjustable yardage shooting pins further comprise adjustable yardage circular peep-sights.

5. The archery bow sight as claimed in claim 3, further comprising a means of reducing torque and shock produced by the archery bow being shot, said means of reducing torque and shock being attached to said front sight and comprising:

a dead weight, said dead weight being slidably mounted on said archery bow sight by means of a threesome of holes through said dead weight;

said dead weight being slidably mounted on said pair of parallel tubular arms of said front sight support and adjustably attached to said front sight support block by a threaded bolt;

said dead weight being slidably mounted on said pair of parallel tubular arms of said front sight support by one each of said pair of parallel tubular arms of said front sight support passing through one each of two of said threesome of holes through said dead weight;

said threaded bolt extending from said front sight support block through a third hole of said threesome of holes of said dead weight towards said mounting block between said pair of parallel tubular arms of said front sight support;

said threaded bolt freely extending through a third hole through said dead weight and threadably engaging said front sight support block; and, said threaded bolt having a pair of springs, with a first spring of said pair of springs being mounted on said threaded bolt between said front sight support block and said dead weight and a second spring of said pair of springs being mounted on said threaded bolt between said dead weight and a head of said threaded bolt.

6. A method of reducing torque and shock produced by an archery bow being shot comprising the steps of:

providing an archery bow sight for use with an archery bow having a bowstring, an arrow rest and a handgrip portion;

providing a mounting block on said archery bow sight, said mounting block for attachment to the archery bow;

providing a front sight on said archery bow sight, said front sight being adjustably attached to said mounting block;

providing a rear sight on said archery bow sight, said rear sight being adjustably attached to said mounting block;

providing a means of reducing torque and shock produced by the archery bow being shot on said archery bow sight, said means of reducing torque and shock including a dead weight slidably mounted on a pair of parallel tubular arms of a front sight support on said archery bow sight, a threaded bolt extending from a front sight support block on said archery bow sight through said dead weight towards said mounting block between said pair of parallel tubular arms of said front sight support, a pair of springs being mounted on said threaded bolt wherein a first spring of said pair of springs is mounted on said threaded bolt between said front sight support block and said dead weight and a second spring of said pair of springs is mounted on said threaded bolt between said dead weight and a head of said threaded bolt;

placing compression upon said pair of springs mounted on said threaded bolt by tightening said head of said threaded bolt and thereby adjusting the slidability of said dead weight on said pair of parallel tubular arms of said front sight support and said threaded bolt; and, telescopically adjusting the length of said front sight and said rear sight with respect to each other and said mounting block.

* * * * *